United States Patent [19]

Stone, deceased

[11] 4,043,540

[45] Aug. 23, 1977

[54] MIXER PADDLE ASSEMBLY AND DRIVE SYSTEM

[75] Inventor: Guthrie B. Stone, deceased, late of Honeoye, N.Y., by Alan J. Stone, administrator

[73] Assignee: Stone Construction Equipment, Inc., Honeoye, N.Y.

[21] Appl. No.: 617,154

[22] Filed: Sept. 26, 1975

[51] Int. Cl.[2] ..... B28C 7/16; B28C 5/14

[52] U.S. Cl. ..... 259/171; 259/178 R

[58] Field of Search ..... 259/10, 46, 110, 171, 259/178 R, 109, 9, 170, 169, 178 A

[56] References Cited

U.S. PATENT DOCUMENTS

| | | | |
|---|---|---|---|
| 2,576,575 | 11/1951 | Collins | 259/109 |
| 2,668,695 | 2/1954 | Lichtenberg et al. | 259/171 |
| 2,723,110 | 11/1955 | Collins | 259/110 |
| 2,961,224 | 11/1960 | Wright | 259/109 |
| 3,100,064 | 8/1963 | Kacena | 259/171 X |
| 3,363,883 | 1/1968 | Anderson | 259/109 |
| 3,570,569 | 3/1971 | Hartley et al. | 259/46 X |

*Primary Examiner*—Robert W. Jenkins

*Attorney, Agent, or Firm*—Clarence A. O'Brien; Harvey B. Jacobson

[57] ABSTRACT

A plaster or mortar mixer embodying a stub shaft mounting assembly for the mixer paddles disposed interiorly of the mixing drum and a reduction gear drive system enabling use of a standard electric motor or universal internal combustion engine with the reduction drive system employing a belt and pulleys, a sprocket chain and sprocket gears and a meshing gear assembly which eliminates the necessity of a relatively expensive reduction gear unit thereby rendering the mixer less expensive to manufacture and maintain. The stub shaft mounting of the mixer paddles enables the paddles to be permanently and rigidly secured to the paddle shaft in the form of a supporting tube such as by welding or the like with the stub shafts detachably connected to the tube in order to facilitate the removal of and replacement of the paddles and tube.

7 Claims, 3 Drawing Figures

MIXER PADDLE ASSEMBLY AND DRIVE SYSTEM

BACKGROUND OF THE INVENTION

1. Field of the Invention

The present invention generally relates to mixers for use in mixing plaster, mortar or the like and includes a pivotally mounted drum which can be pivoted to a dumping position about a horizontal axis together with a rotatable paddle assembly disposed interiorly of the drum and driven by a prime mover mounted on a portable frame or the like in which the paddle assembly includes a novel and unique stub shaft mounting for the paddle shaft and paddles and a drive system enabling alternate use of an electric motor or a small internal combustion engine either of which is readily available without necessitating the purchase and utilization of a relatively expensive reduction gear unit.

2. Description of the Prior Art

Plaster and mortar mixers which include a pivotal drum in which mixing paddles rotate have been manufactured by the assignee for a number of years with prior U.S. Pat. Nos. 3,334,871, issued Aug. 8, 1967 disclosing a cover guard arrangement for the mixing drum, 3,905,519, issued Sept. 16, 1975 illustrating a latching and unlatching assembly for the pivotal mixing drum. Other prior patents such as U.S. Pat. Nos. 1,630,789, issued May 31, 1927, 2,668,695, issued Feb. 9, 1954 and 1,708,947, issued April 1929 disclose mixers of this type. Such devices usually are mounted on a wheeled frame and a prime mover is mounted on the frame and is in driving connection with a paddle shaft which extends longitudinally through the mixer drum with a plurality of paddles being secured to the paddle shaft. A large gear is attached to the paddle shaft externally of the drum and is in meshing engagement with a smaller pinion gear which, in turn, is drivingly connected to an electric motor or a small internal combustion engine of appropriate horsepower. In view of the relatively slow rotational speed required for the paddle shaft, a reduction gear unit is usually obtained along with the prime mover as a composite unit which materially increases the cost of the mixer since conventional and universally employed electric motors or internal combustion engines cannot be used. In addition, the individual paddles are bolted to the paddle shaft which enables removal of the paddles but also introduce a bolted joint which sometimes can become loosened and requires each paddle to be individually removed from the paddle shaft in order to replace wear components provided on the paddles.

SUMMARY OF THE INVENTION

An object of the present invention is to provide a paddle assembly for a plaster or mortar mixer of the type having a pivotal drum and a rotatable paddle shaft extending therethrough with the paddle shaft including a central tubular member disposed within the drum and having a plurality of paddles welded thereto and a pair of stub shafts secured to the ends of the tubular paddle shaft and being journaled in suitable sealed bearings in the end walls of the drum with one of the stub shafts having the large drive gear secured thereto externally of the drum end wall.

Another object of the invention is to provide a mixer having a unique drive system employing belts, pulleys, sprocket chains and gears for driving a small drive pinion in meshing engagement with the large drive gear to enable conventional, over-the-counter, universal electric motors and internal combustion engines to be alternatively employed as a prime mover for driving the paddle shaft at a required speed without the necessity of employing an expensive reduction gear unit.

Still another object of the invention is to provide a plaster and mortar mixer having a paddle assembly and drive system in accordance with the preceding objects which is less expensive to manufacture than presently available mixers, requires less maintenance and enables maintenance to be accomplished in less time and with less labor.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
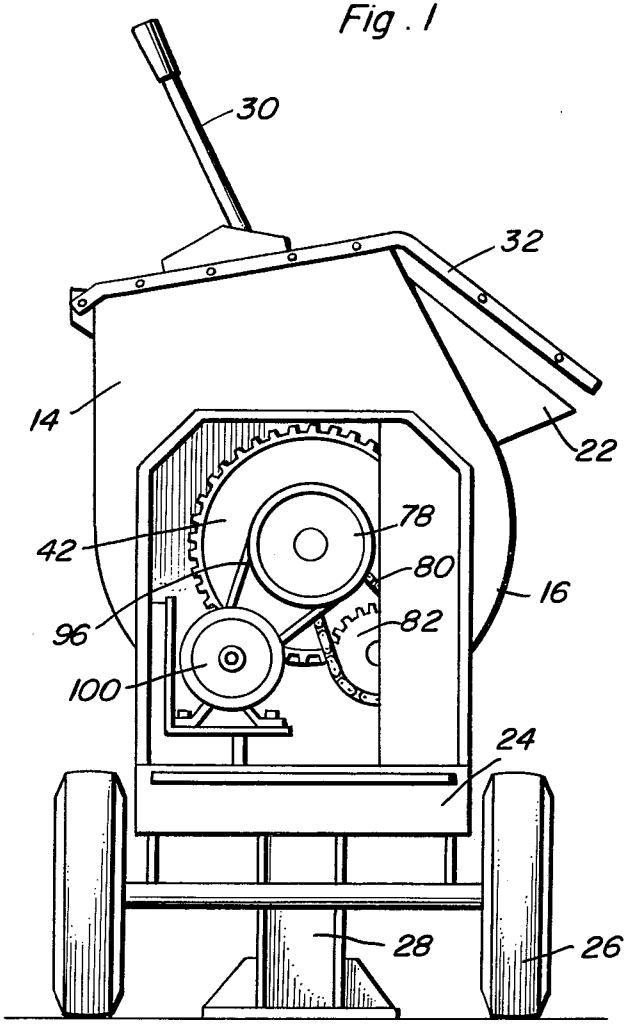
FIG. 1 is an end elevational view of the drive system for the mixer illustrating an electric motor as the prime mover.

Referring now specifically to the drawings, the plaster or mortar mixer is generally designated by the numeral 10 and includes a mixer drum generally designated by numeral 12 which includes end walls 14 and a curved peripheral wall 16 having an open top 18 and a discharge opening 20 defined by a chute 22 all of which represents conventional construction. The mixer 10 includes a supporting framework 24 having a pair of wheels 26 at one end thereof and a supporting prop or legs 28 at the other end with this construction forming no particular part of the present invention. The drum 12 also includes a handle 30 for pivoting the drum about a horizontal axis for movement between an upright position illustrated in FIG. 1 to a dumping position with a guard 32 being provided over the opening 18 and the opening 20 which swings away from the chute 22 when the drum 12 is pivoted to a dumping position in which the chute 22 inclines downwardly for discharging the material from the mixer drum 12 into a suitable vehicle such as a wheelbarrow or the like.

The frame 24 includes uprights 36 and 38 which journal a paddle shaft 40 which extends longitudinally through the mixer drum 12 for providing not only a pivotal support for the drum 12 but also provides rotational movement of the paddle shaft 40 in relation to the drum 12. The paddle shaft assembly 40 includes one end which extends beyond the upright 38 and is drivingly connected with a large drive gear or bull gear 42 which is in meshing engagement with a small pinion gear 44 thereby driving the paddle shaft 40 at a reduced speed in relation to the driving pinion gear 44. Th bull gear 42 and the driving pinion gear 44 are disposed in a suitable enclosure or housing 46.

In previous structures, the paddle shaft 40 has included an elongated rod or shaft extending throughout the length of the drum and projecting beyond the ends of the drum with paddles being secured to the paddle shaft by bolt-type fasteners or the like. In this construction, the paddle shaft 40 includes an elongated tubular shaft 48 which extends substantially from end to end of the drum but terminates inwardly from the end walls 14 thereof. Rigidly affixed to the tubular paddle shaft 48 is a plurality of paddles 50 and 52 which are fixedly secured thereon as by welding 54 so that the paddles and the paddle shaft become a unitary and integral structure thereby eliminating bolt-type connections between a paddle shaft and paddles.

Figure 2:
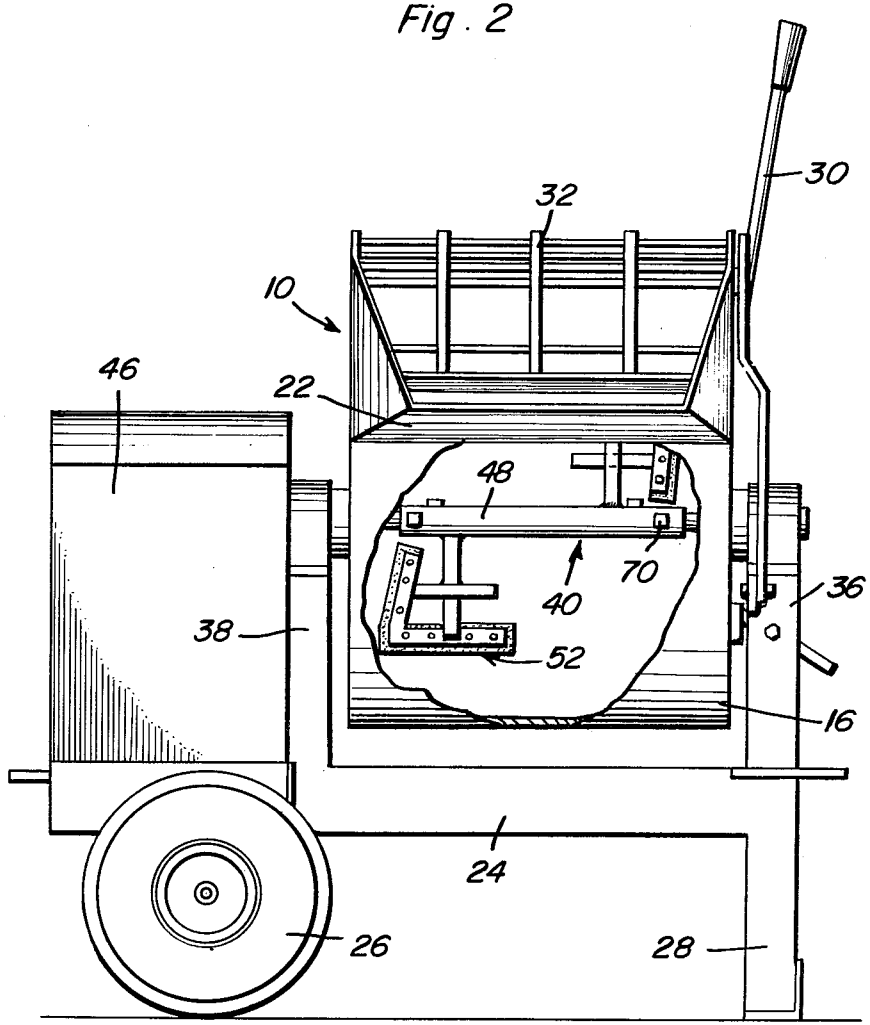
FIG. 2 is a side elevational view of the construction of FIG. 1 with a portion of the mixer drum broken away illustrating the tubular paddle shaft and stub shafts extending therefrom.
Figure 3:
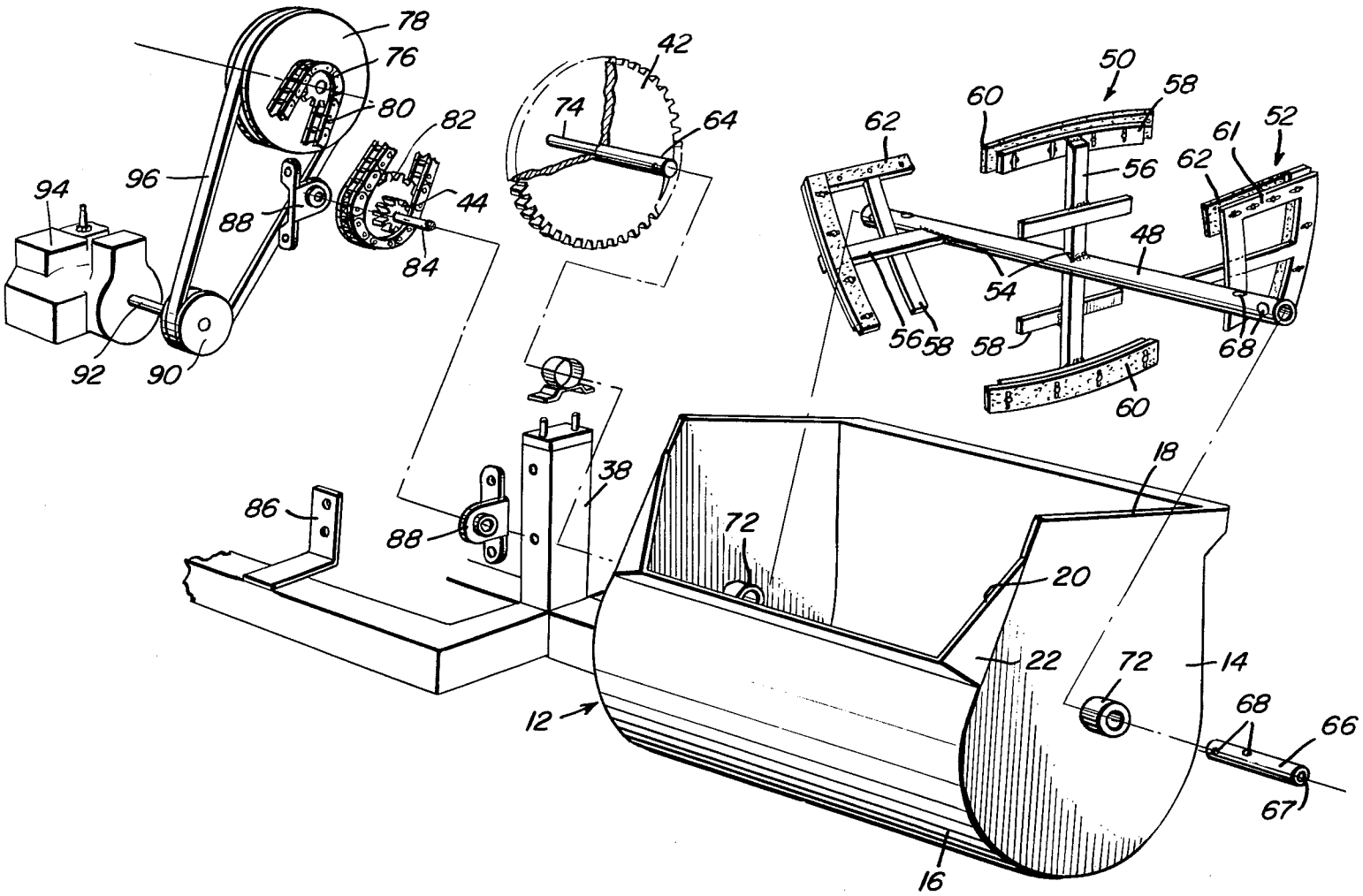
FIG. 3 is an exploded group perspective view illustrating the construction of the mixer drum, paddle shaft, stub shafts and drive system with an internal combustion engine employed as the prime mover.

The construction and arrangement of the paddles 50 and 52 may be varied depending upon the size of the drum and the material to be mixed. On a smaller drum such as illustrated in FIG. 2, a pair of end paddles 52 may be employed while in a slightly larger drum as illustrated in FIG. 3, in addition to the end paddles 52, a pair of center paddles 50 may be employed with each of the paddles including radial members 56 and transverse members 58 with the outermost transverse members 58 being provided with a rubber blade 60 thereon. In the end paddles, the transverse members 58 have an interconnecting member 61 at one end thereof which is also provided with a rubber blade 62. The particular construction and arrangement of the paddles in and of themselves may vary depending upon the particular size of mixer and materials to be mixed with the rubber blades being replaceable and resistant to abrasion due to the materials being mixed. Also, the blades are properly associated with each other and with the drum so that the material within the drum will be thoroughly mixed during rotation of the hollow paddle shaft 48 which may be in the form of a pipe which is hollow throughout its length or may be in the form of a shaft having hollow ends. In either event, the ends of the hollow shaft 48 receive telescopically a short stub shaft 64 and 66 therethrough with the ends of the hollow paddle shaft 48 and the ends of the stub shafts 64 and 66 received respectively therein having pairs of alignable openings 68 for receiving bolt type fasteners 70 therethrough thus securing the stub shafts 64 and 66 into the ends of the hollow paddle shaft 48 so that the stub shafts 64 and 66 extend through bearing and seal assemblies 72 in each end wall 14 of the drum 16 and also suitable bearing and seal assemblies supported at the upper ends of the standards 36 and 38. The specific details of the bearing and seal assemblies are disclosed in a copending application Ser. No. 472,466, filed May 22, 1974 by Christian T. Tertinek and Alan J. Stone now U.S. Pat. No. 3,932,006, issued Jan. 13, 1976, and assigned to the same assignee. The stub shaft 64 at the engine end of the mixer is provided with a reduced end that is keyed to and fixedly secured to the large spur gear 42 and includes an extending end portion 74 of reduced diameter which journals a small sprocket gear 76 and a pulley 78 which are rigidly secured to each other and form a rigid assembly journaled on the reduced extension 74 of the stub shaft 64 by suitable bearings and retainers. The stub shaft 66 has an internally threaded end 67 to captivate the shaft. As illustrated in FIG. 3, the small sprocket gear 76 engaged by a sprocket chain 80 that is entrained around a larger sprocket gear 82 rigid with gear 44 and which are supported on a stub shaft 84 journaled on a pair of bearings 88, one of which is secured to the side of the standard 38 and one of which is secured to a special bracket 86.

The belt pulley 78 is in alignment with a drive pulley 90 supported on the output shaft 92 of an internal combustion engine 94 with a drive belt 96 interconnecting the pulleys 90 and 78 with the pulleys and belt being of a conventional V construction and either a single or multiple grooved pulley and belt arrangement may be used. With this construction, a conventional, universal internal combustion engine 94 may be employed with the drive pulley 90 being secured directly to the output shaft 92 by a suitable key or other secure connection thus enabling a conventional, "over-the-counter" internal combustion engine 94 to be employed. The engine base may be adjustably supported on the frame in any suitable manner to enable the belt 96 to be tightened or loosened. In lieu of an internal combustion engine, the prime mover for driving the paddle shaft may be in the form of an electric motor 100 driving the pulley 90 and V belt 96 in the same manner as the internal combustion engine with the speed reduction provided between the pulley 90 on either the engine 94 or the motor 100 and the pulley 78 and the reduction between the sprocket gears 76 and 82 and the reduction between the gears 44 and 42 enabling the paddle shaft assembly 40 to be driven at the required rotational speed.

This construction is substantially less expensive to produce and requires less maintenance and when maintenance is required, less time and labor is necessary to replace or repair components. One of the cost factors which has been reduced is the elimination of the necessity of obtaining a relatively expensive reduction gear unit either incorporated into or added onto the electric motor or internal combustion engine.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a mixer having a drum, a paddle shaft having a plurality of paddles thereon, and means journaling the paddle shaft for rotation mixing material in the drum, that improvement comprising a rive assembly for driving said paddle shaft at a slow rotational speed including a large driven gear connected to the paddle shaft, a small driving gear meshed with the large gear, a power device having an output shaft driven at a high speed, and a speed reduction assembly interconnecting the output shaft and small driving gear, said speed reduction assembly including coplanar small and large pulleys and an encircling belt and coplanar small and large sprocket gears and an encircling chain arranged in series relationship.

2. The structutre as defined in claim 1 wherein the small pulley is mounted on the output shaft, the large pulley and small sprocket gear being journaled on a projecting end portion of the paddle shaft outwardly of the large driven gear, said large pulley and small sprocket gear being rigidly connected, the large sprocket gear being rigid with respect to the small driving gear.

3. In a mixer having a pivotally supported drum, a paddle shaft extending longitudinally of the drum and including paddles thereon, means disposed exteriorly of the drum for driving the paddle shaft, that improvement comprising shaft means connected with the paddle shaft and forming longitudinal extensions thereof, said shaft means being journaled in the opposite walls of the drum and being accessible exteriorly of the drum, and means detachably connecting the shaft means with the paddle shaft to enable separation of the shaft means from the paddle shaft and removal of the paddle shaft and paddles from the drum without removing the drum from its support, said shaft means being in the form of a pair of stub shafts, each of said stub shafts being connected with an end portion of the paddle shaft closely adjacent to but spaced from the opposite walls of the drum, said stub shafts extending exteriorly of the drum for longitudinal removal of the stub shafts when the inner ends of the stub shafts are disconnected from the end portions of the paddle shaft, said paddles being rigidly and permanently secured to the paddle shaft, the opposite walls of the drum having external bearing assemblies journaling the drum for pivotal movement about a longitudinal axis concentric with the rotational axis of the paddle shaft with the bearing assemblies enabling insertion and removal of the stub shafts longitudinally in relation to the end portions of the paddle shaft.

4. The structure as defined in claim 3, wherein said means for driving the paddle shaft includes a prime mover, a speed reduction assembly interconnecting the prime mover and one of said stub shafts, said speed reduction assembly including a pair of meshed gears with one of the gears being secured to one of the stub shafts to enable longitudinal removal of the stub shaft and longitudinal movement of the meshed gears in relation to each other when the stub shaft is longitudinally removed from the drum wall.

5. The structure as defined in claim 4, wherein said speed reduction assembly also includes a belt and pulley assembly and a sprocket chain and sprocket gear assembly arranged in series relation between the prime mover and pair of meshed gears thereby eliminating the necessity of employing a reduction gear unit, said prime mover including a relatively high speed output shaft connected to a smaller pulley of the belt and pulley assembly thereby enabling selective use of an electric motor or an internal combustion engine as a prime mover.

6. The structure as defined in claim 5, wherein said drum includes handle means thereon to pivot the drum from a mixing position to a dumping position, said drum including a lateral opening between opposite end walls forming means enabling placement of materials to be mixed therein and discharge of mixed materials when pivoted to a dumping position, said bearing assembly on the opposite walls of the drum including outwardly projecting cylindrical bosses supported on longitudinally spaced support members forming a portion of a mobile frame having wheel means thereon to facilitate transport of the mixer to a desired site, said prime mover and speed reduction assembly being mounted on said frame and connected with the stub shaft on the end thereof which projects through the bearing assembly to the side of the support remote from the drum.

7. In a mixer having a pivotally supported drum provided with opposed end walls, a paddle shaft extending longitudinally of the drum and including paddles thereon, the opposed end walls of the drum having external bearing assemblies journaling the drum for pivotal movement about a longitudinal axis concentric with the rotational axis of the paddle shaft, means disposed exteriorly of the drum for driving the paddle shaft, that improvement comprising shaft means connected with the paddle shaft and forming longitudinal extensions thereof, said shaft means being journaled in the bearing assemblies on the opposed end walls of the drum and being accessible exteriorly of the bearing assemblies, and means detachably connecting the shaft means with the paddle shaft to enable separation of the shaft means from the paddle shaft, said bearing assemblies enabling insertion and removal of the shaft means longitudinally in relation to the paddle shaft and bearing assemblies thereby enabling removal of the paddle shaft and paddles from the drum without removing the drum from its support.

* * * * *